US007100914B2

(12) United States Patent
Ramos

(10) Patent No.: US 7,100,914 B2
(45) Date of Patent: Sep. 5, 2006

(54) SHEET MEDIA INPUT

(75) Inventor: Juan D. Ramos, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/758,057

(22) Filed: Jan. 15, 2004

(65) Prior Publication Data

US 2005/0156372 A1 Jul. 21, 2005

(51) Int. Cl.
*B65H 3/52* (2006.01)

(52) U.S. Cl. ..... 271/121; 271/124

(58) Field of Classification Search ..... 271/121, 271/124

See application file for complete search history.

(56) References Cited

U.S. PATENT DOCUMENTS

| | | | | |
|---|---|---|---|---|
| 5,882,004 | A * | 3/1999 | Padget | 271/119 |
| 5,938,355 | A * | 8/1999 | Suzuki | 400/624 |
| 6,116,589 | A * | 9/2000 | Bortolotti | 271/121 |
| 6,126,161 | A * | 10/2000 | Kato | 271/121 |
| 6,217,017 | B1 * | 4/2001 | Yamazaki | 271/121 |
| 6,382,621 | B1 | 5/2002 | Inoue et al. | |
| 6,663,098 | B1 * | 12/2003 | Teo et al. | 271/121 |
| 2002/0050680 | A1 * | 5/2002 | Yanagi et al. | 271/121 |
| 2002/0070495 | A1 * | 6/2002 | Takeuchi | 271/121 |
| 2003/0184005 | A1 * | 10/2003 | Takito et al. | 271/121 |

FOREIGN PATENT DOCUMENTS

| | | |
|---|---|---|
| JP | 04066436 | 3/1992 |
| JP | 867367 | 8/1994 |
| JP | 8113384 | 5/1996 |
| JP | 11208914 | 8/1999 |
| JP | 2000143023 | 5/2000 |
| JP | 2003285948 | 10/2000 |
| JP | 2001019194 | 1/2001 |

OTHER PUBLICATIONS

European Search Report for Application No. EP 04017404. Report completed Apr. 11, 2005 at The Hague.

* cited by examiner

*Primary Examiner*—David H. Bollinger

(57) ABSTRACT

In one embodiment, a sheet media input structure includes a sheet supporting surface, a movable pad downstream from the supporting surface, and a pair of stationary pads downstream from the supporting surface at a location where the stationary pads impede a leading edge of sheets fed from a stack of sheets supported by the supporting surface. The movable pad is movable between a first position in which the movable pad impedes a leading edge of sheets fed from the stack and a second position in which the movable pad does not impede the leading edge of sheets fed from the stack.

16 Claims, 7 Drawing Sheets

SHEET MEDIA INPUT

BACKGROUND

In many conventional printers, individual sheets of paper or other print media are fed into the printer off the top of a stack of sheets held in a horizontally oriented tray. Typically, a pick roller is rotated against the top sheet to slide the top sheet off the stack and into the printer. Friction between sheets in the stack sometimes causes the top two or three sheets in the stack to stick together as the top sheet is picked from the stack. The next-to-top sheets must be separated from the top sheet to avoid feeding multiple sheets into the printer at the same time. In one conventional input structure for a horizontal feed printer, the next-to-top sheets are separated from the top sheet by driving the sheets across an elastomeric pad positioned at the front of the media input tray. This pad is often referred to as a separator pad because it's function is to separate the top sheet in the stack from next-to-top sheets in the stack so that only the top sheet moves into the printer. In some printers, such as Hewlett-Packard Company's Deskjet® 5150 model injet printer, the separator pad is lifted against the pick roller at the beginning of the pick cycle and then quickly lowered to momentarily increase the separating effect of the pad.

The active separator pad design used in the Deskjet® 5150 works well when media sheets are picked from a horizontal stack, where the separator pad need overcome only the friction force between sheets. If this active separator pad design is used when sheets are picked from a vertically oriented stack, however, gravity can pull multiple sheets into the media path as soon as the pad is moved away from the pick roller, resulting in more than one sheet being fed into the printer.

DRAWINGS

DESCRIPTION

Embodiments of the present invention were developed in an effort to adapt an active separator pad design from a conventional horizontal feed printer to a new vertical feed printer. Embodiments of the invention will be described with reference to the vertical feed inkjet printer shown in FIGS. 1–3. The invention, however, is not limited to use with inkjet printers or vertical feed printers. Embodiments of the invention may be implemented in other printers or other sheet media processing devices. While the invention is not limited to use with vertical feed printers, it is expected that various embodiments of the invention will be particularly useful in such printers.

Figure 1:
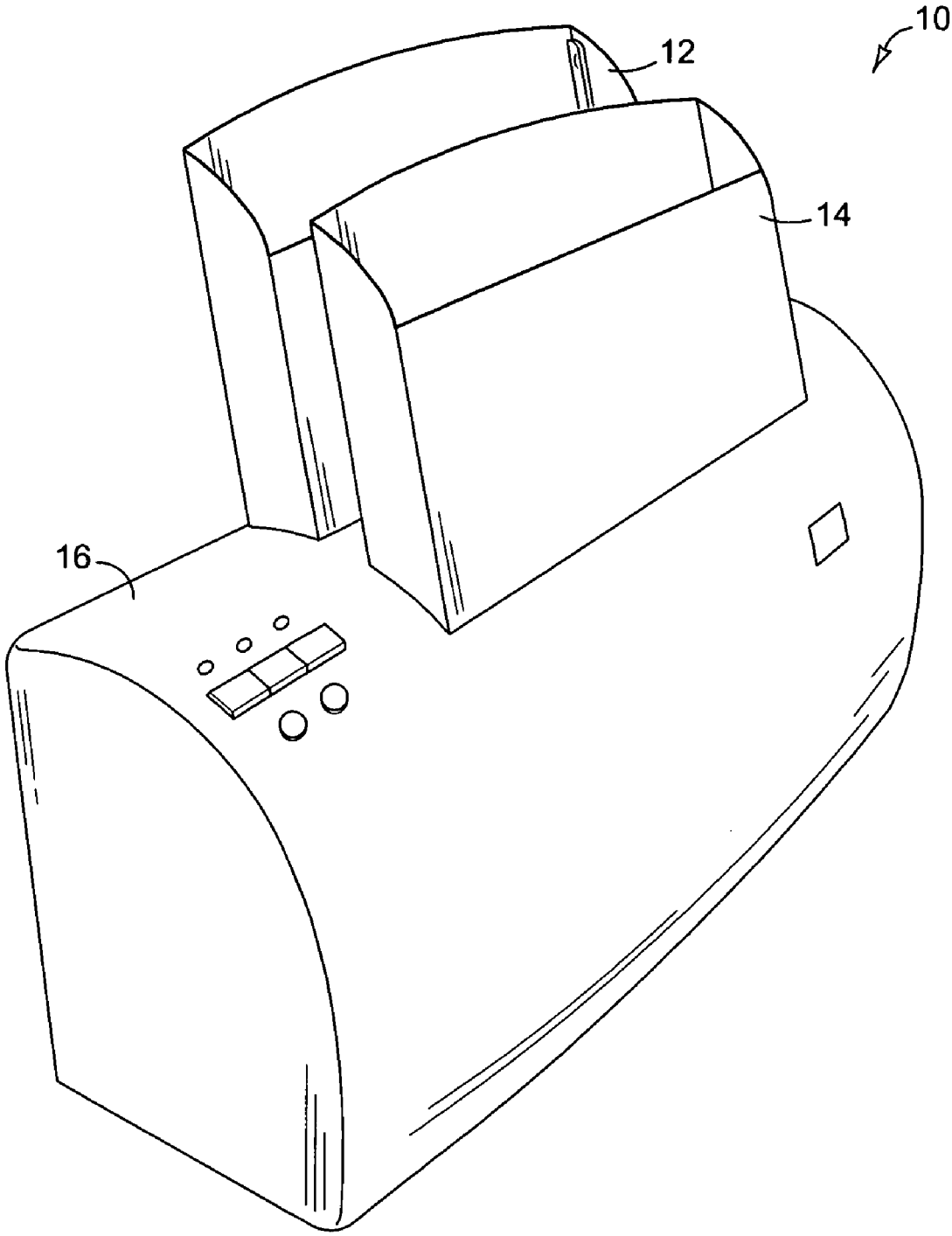
FIG. 1 is a perspective view of the outside of a vertical feed inkjet printer constructed according to one embodiment of the invention.
Figure 2:
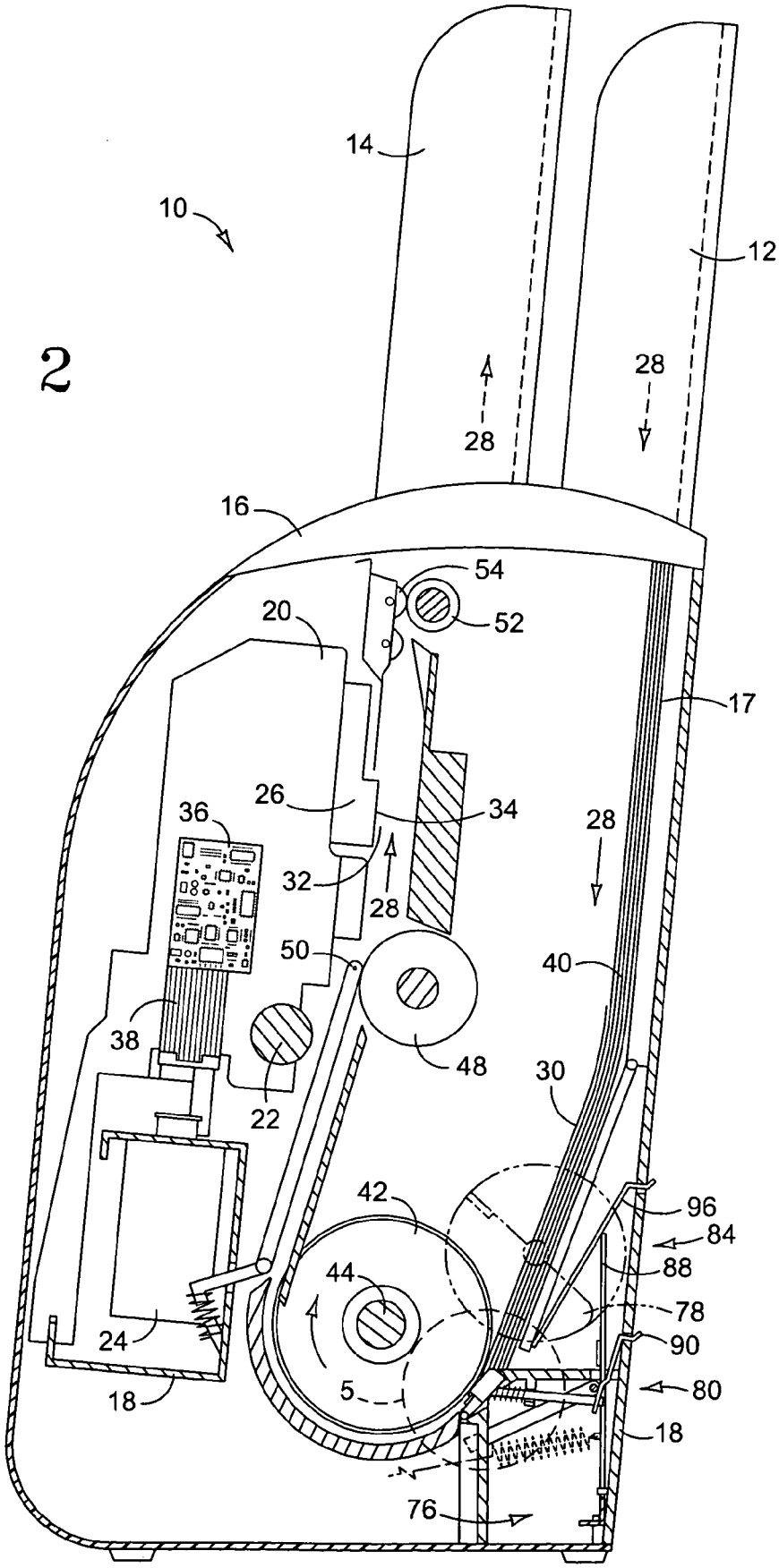
FIGS. 2 and 3 are side elevation and partial section views of the vertical feed inkjet printer shown in FIG. 1.
Figure 3:
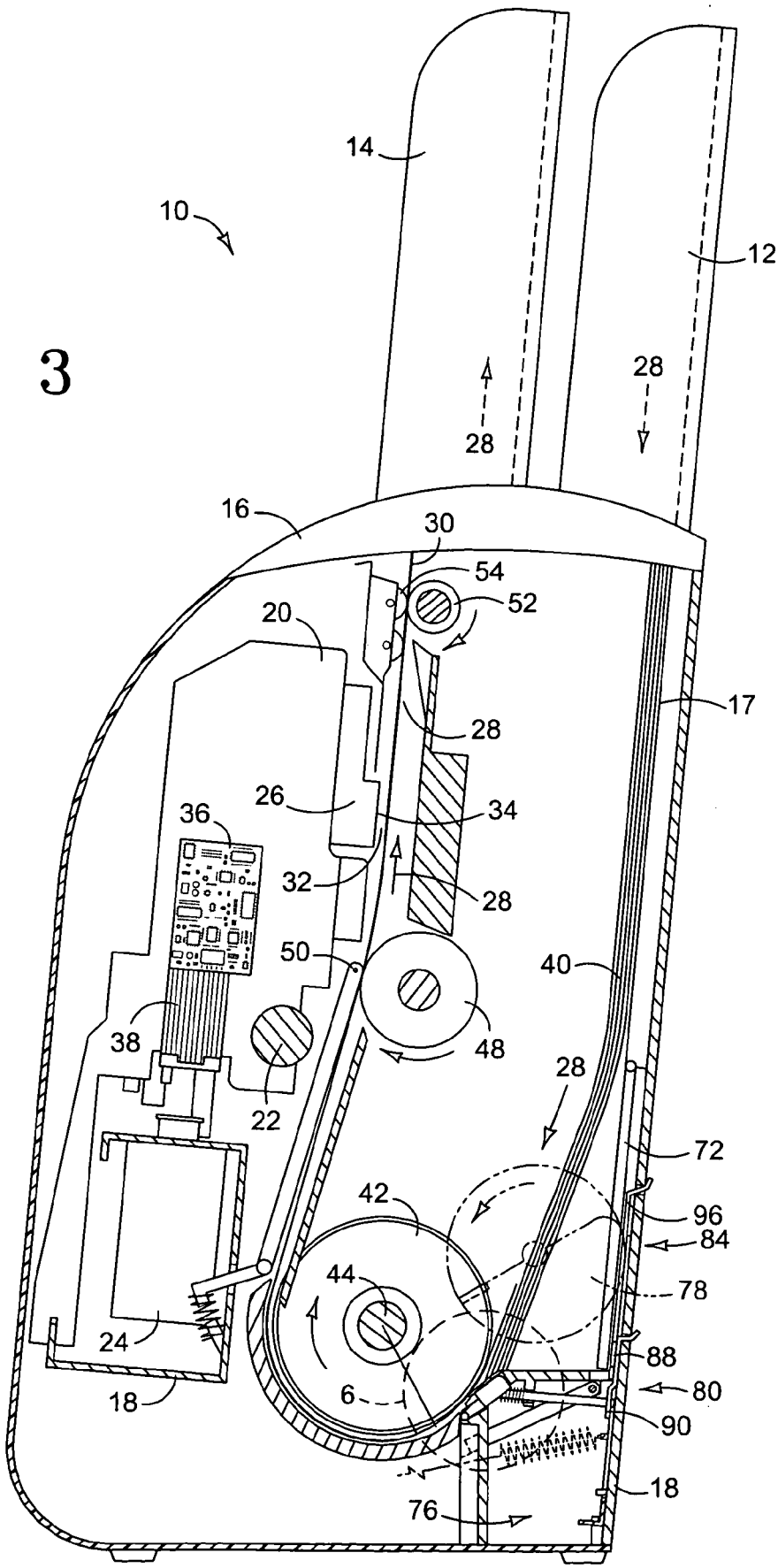

FIG. 1 illustrates an inkjet printer 10. FIGS. 2 and 3 are side elevation and partial section views of printer 10. Referring first to FIGS. 1–3, printer 10 includes a an input sheet media tray 12 and an output sheet media tray 14 supported by a housing 16. Input tray 12 includes a substantially vertical sheet media supporting surface 17. "Substantially vertical" as used in this document means within 5 degrees of true vertical. Printer 10 includes a chassis 18 that supports the operative components of printer 10. Chassis 18 represents generally those parts of printer housing 16 along with other structurally stable elements in printer 10 that support the operative components of printer 10.

A printhead carriage 20 is driven back and forth along a guide rail 22 mounted to chassis 18. Any suitable drive mechanism may be used to move carriage 20. A reversing motor 24 coupled to carriage 20 through a belt and pulley system, for example, is one carriage drive mechanism commonly used in inkjet printers. Carriage 20 has stalls for holding one or more printheads 26. Printheads 26 are also commonly referred to as print cartridges or ink cartridges. Each printhead 26 is positioned along a media path 28 such that each sheet of print media 30 passes directly by printhead 26 at a print zone 32. The portion 34 of each printhead 26 that faces media sheet 30 includes an array of nozzles through which drops of ink are ejected onto media sheet 30.

An electronic printer controller 36 receives print data from a computer, scanner, digital camera or other image generating device. Controller 36 controls the movement of carriage 20 back and forth across media sheet 30 and the advance of media sheet 30 along media path 28. Printer controller 36 is also electrically connected to printhead 26 through, for example, a flexible ribbon cable 38. As carriage 20 carries printhead 26 across media sheet 30, printer controller 36 selectively activates ink ejection elements in printhead 26 according to the print data to eject ink drops through the nozzles onto media sheet 30. By combining the movement of carriage 20 across media sheet 30 with the movement of sheet 30 along media path 28, controller 36 causes printhead 26 to eject ink onto media sheet 30 to form the desired print image.

Figure 4:
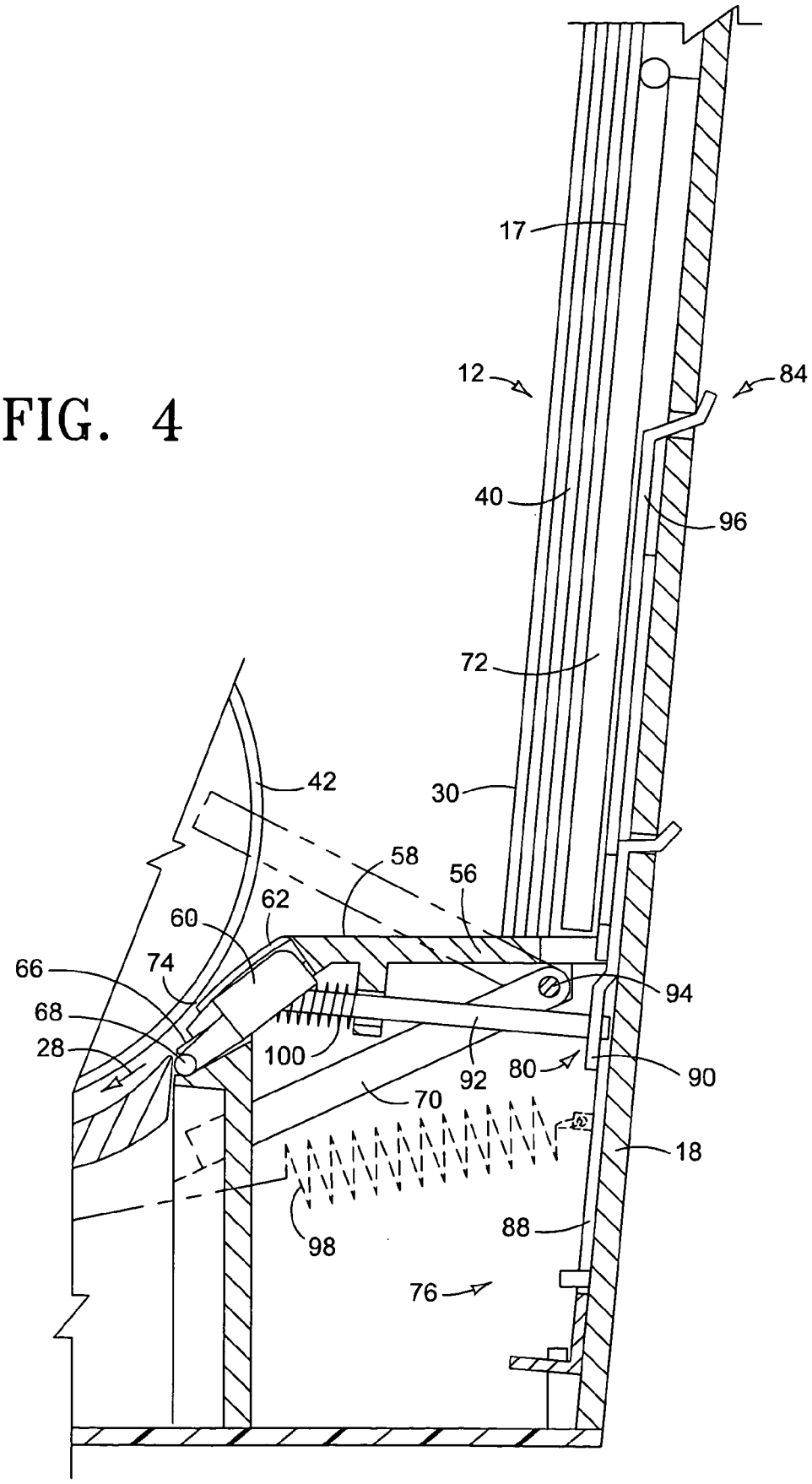
FIGS. 4–6 are detail views of the sheet feed area of the printer shown in FIGS. 1–3.
Figure 5:
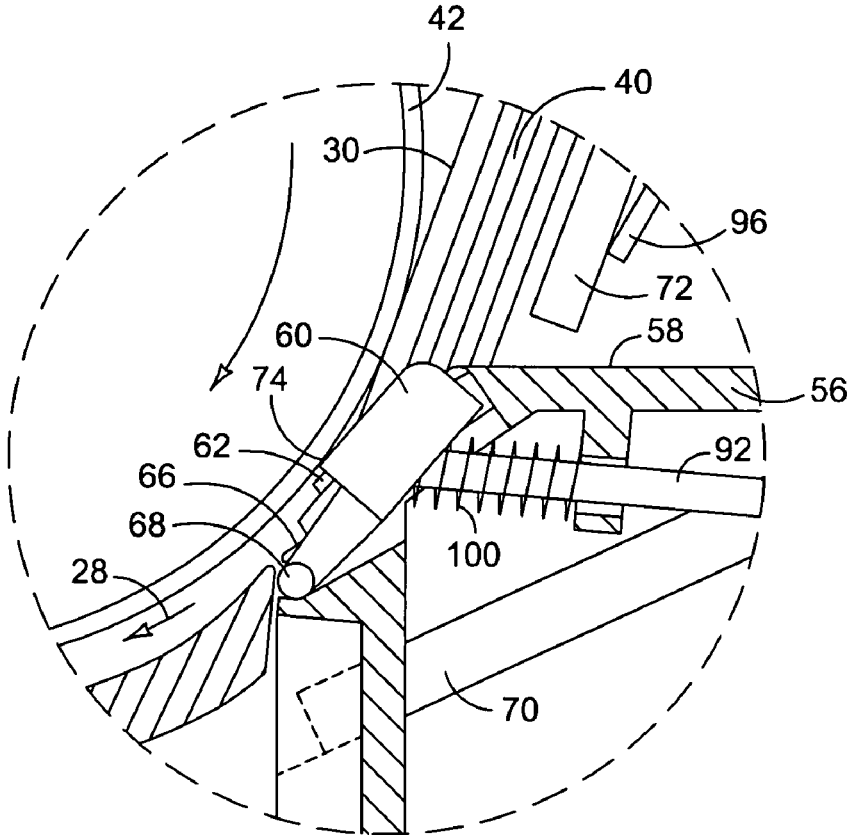
Figure 6:
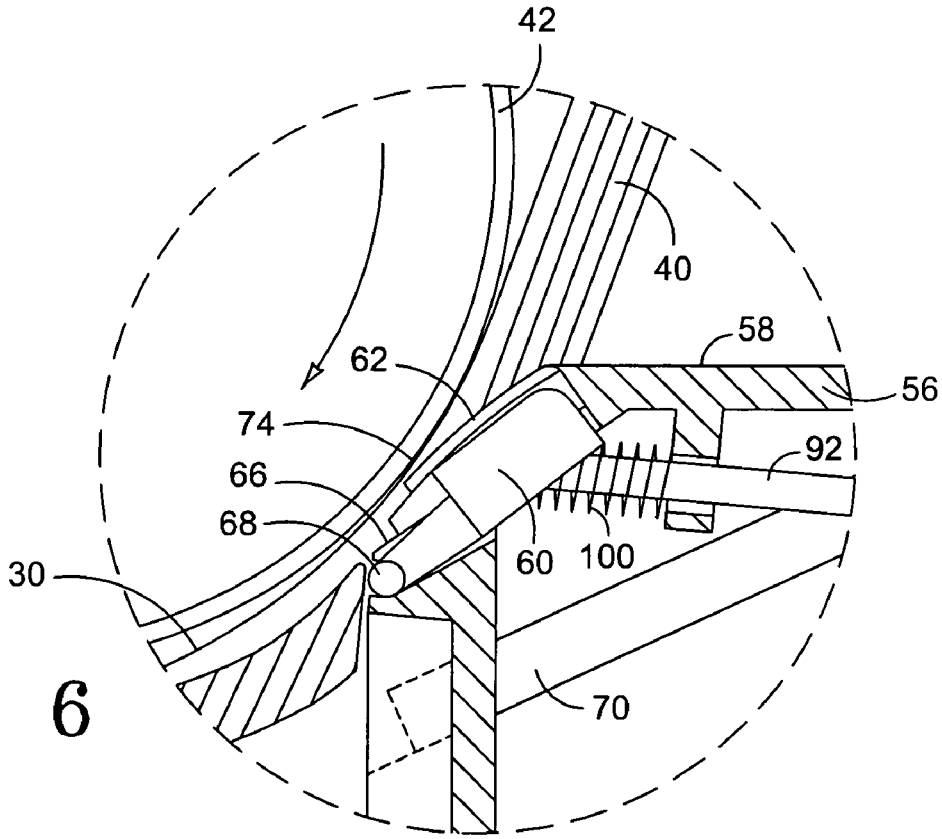
Figure 7:
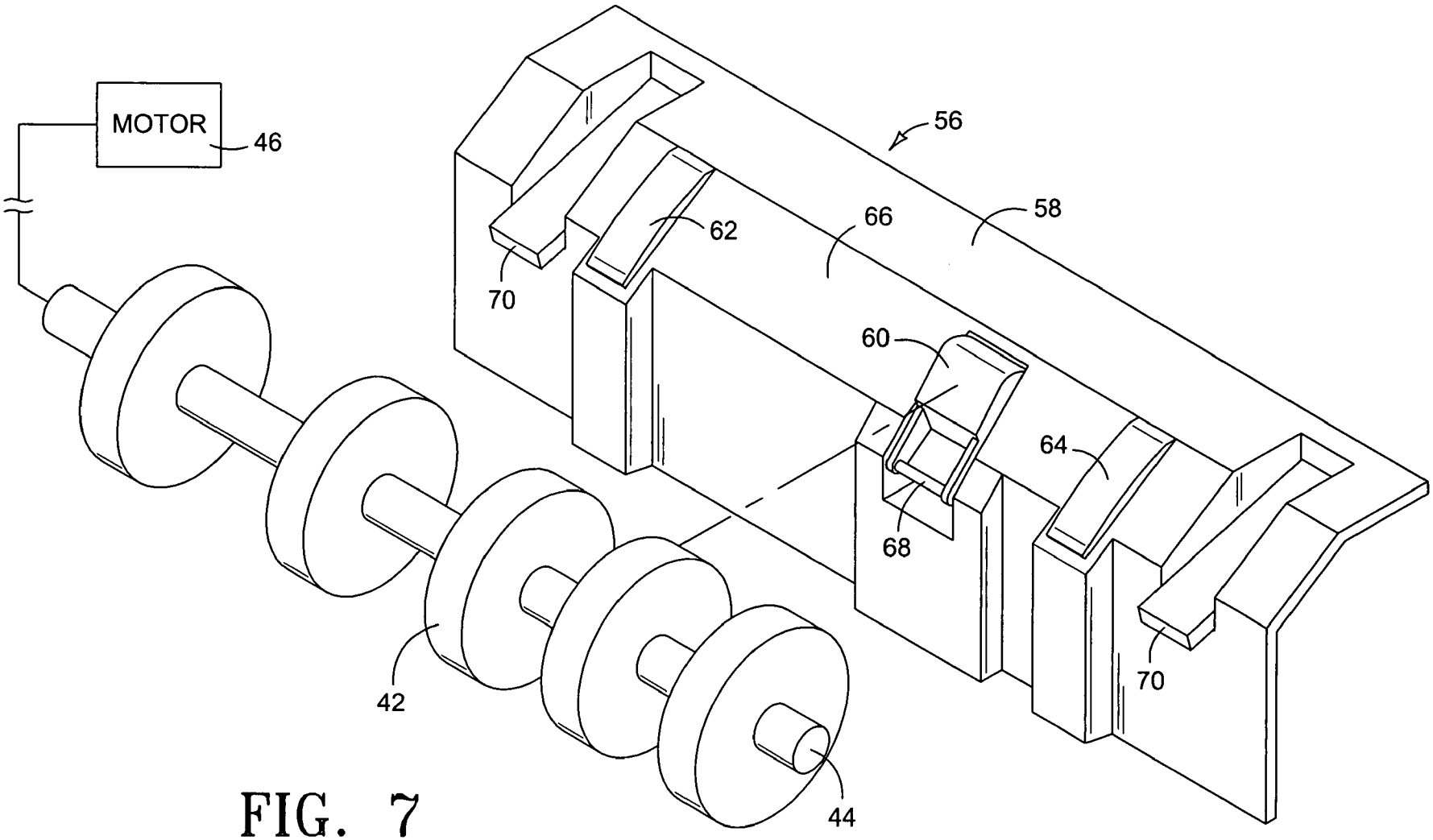
FIG. 7 is a perspective of the separator pads and pick roller of the printer of FIGS. 1–3.
Figure 8:
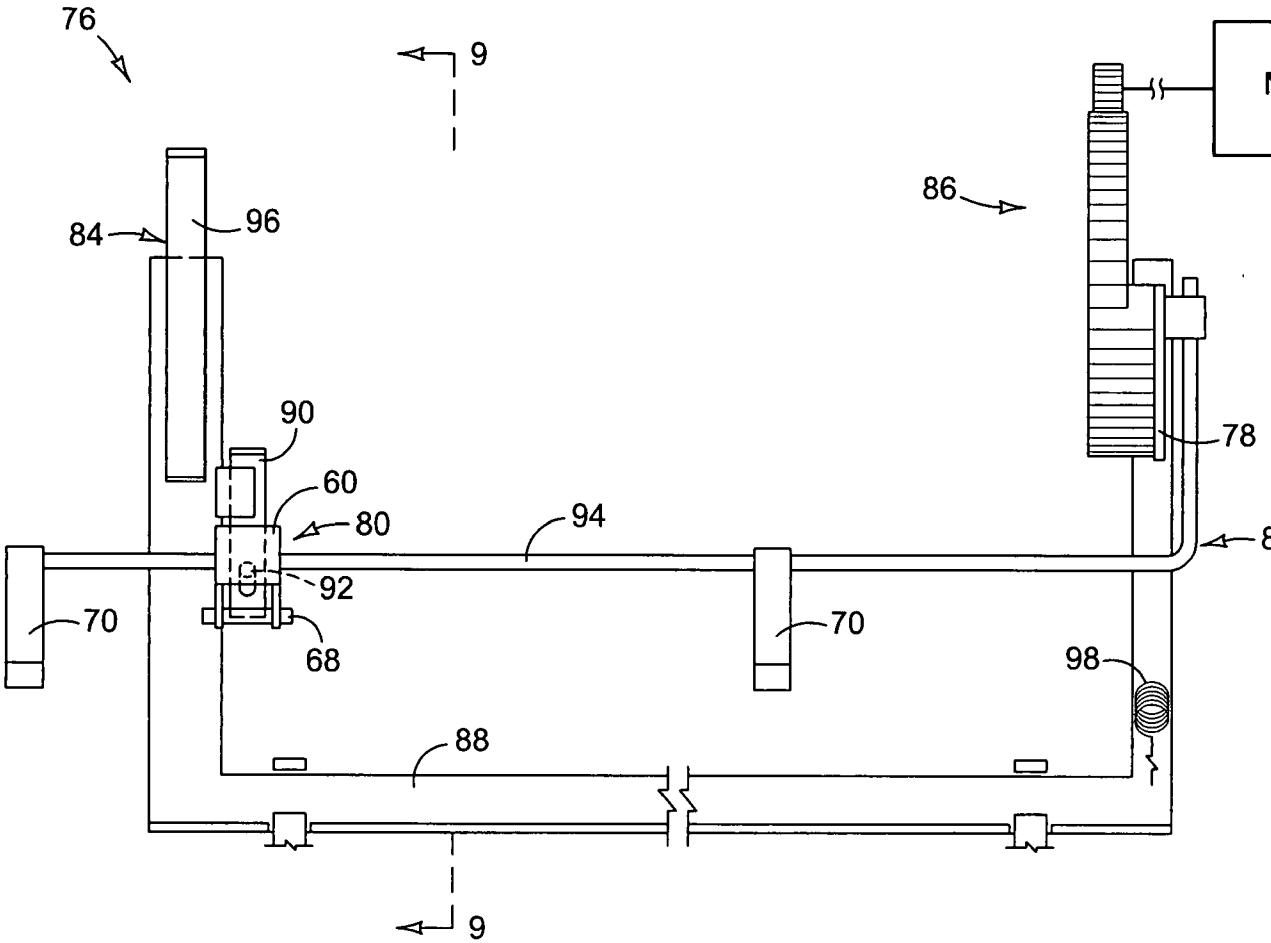
FIG. 8 is a front elevation view of a separator pad actuator used in the printer of FIGS. 1–3.

FIGS. 4–6 are detail views of the sheet feed area of printer 10. The position of feed area components shown in FIGS. 2 and 3 correspond to those shown in the detail views of FIGS. 5 and 6, respectively. FIGS. 2–3 and 5–6 show top sheet 30 "picked" from a stack 40 of media sheets in tray 12 and fed along media path 28. Referring to FIGS. 2–3 and 5–6, when a sheet is needed for printing, a pick roller 42 mounted on a roller shaft 44 is driven clockwise by a motor 46 at the direction of controller 36 to grab top sheet 30 and feed it along media path 28 toward feed rollers 48 (motor 46 is shown in FIGS. 7 and 8). Each feed roller 48 bears against an idler arm 50 to form a nip that moves sheet 30 along toward output rollers 52. Each output roller 52 bears against an idler roller 54 to form a nip that moves sheet 30 into output tray 14.

FIG. 4 is a detail view showing feed area components when printer 10 is at rest, before a pick cycle. FIG. 7 is a detail view showing a lower paper guide 56 and pick roller 42 on shaft 44. Referring to FIGS. 4 and 7, lower paper guide 56 is mounted to chassis 18 below input tray 12. The leading edges of sheets 30 in stack 40 rest along an upper surface 58 of lower paper guide 56. Upper surface 58 is also referred to as shelf 58. Separator pads 60, 62 and 64 are mounted to a sloping surface 66 on lower paper guide 56 immediately below shelf 58. Separator pads 60, 62 and 64, typically formed from an elastomeric material, represent generally any comparatively soft structural feature with a suitably high coefficient of friction that protrudes from sloping surface 66 or otherwise extends into media path 28 downstream from tray 12 to help separate next-to-top sheets carried along with top sheet 30. Separator pad 60 is mounted on a hinge 68 so it can move in and out of media path 28, as described below. Separator pads 62 and 64 are stationary. A pair of stack return "kickers" 70 are hinged to lower paper guide 56.

Referring now to FIGS. 2–6, the lower part of stack 40 is supported in input tray 12 on a hinged pressure plate 72. At the beginning of a pick cycle, pressure plate 72 swings out to press stack 40 against pick roller 42 as best seen by comparing FIGS. 4 and 5. At the same time, separator pad 60 is pressed against pick roller 42 as shown in FIGS. 2 and 5. Pick roller 42 is rotated (clockwise in the figures) to draw top sheet 30 into media path 28, usually along with several next-to-top sheets. Separator pad 60 is then withdrawn from pick roller 42, pressure plate 72 collapses and top sheet 30 continues along media path 28 toward feed roller 48 while any next-to-top sheets drawn into media path 28 remain stuck on separator pads 62 and 64, as shown in FIGS. 2 and 6. The force of pick roller 42 on top sheet 30 is sufficient to overcome the resistance of separator pads 60, 62 and 64 while any next-to-top sheets will be stopped, initially by all three pads 60, 62 and 64 and then by pads 62 and 64 after pad 60 is withdrawn.

Conventional "vertical feed" printers use either active separation or passive separation, but not both. The input tray in these vertical feed printers hold the media stack at about 20 degrees from true vertical. This comparatively low feed angle aids in sheet separation by reducing the effect of gravity but at the cost of a larger footprint. These conventional systems fail to effectively separate next-to-top sheets from the top sheet in a substantially vertical feed printer, such as printer 10. The combined passive and active sheet separation system shown and described herein enables a near vertical feed printer with its minimal footprint while still effectively separating next-to-top sheets from the top sheet.

In some printers, pick roller 42 may still be turning after the trailing edge of top sheet 30 has cleared the separation area. In that case, stationary separator pads 62 and 64 are positioned far enough back from pick roller 42 so that an exposed and still turning pick roller 42 does not grab the next-to-top sheet lying on pads 62 and 64. In the embodiment shown in the figures, separator pads 62 and 64 are constructed as elongated strips that extend below pad 60 to ensure that pads 62 and 64 extend past the area on pad 60 where top sheet 30 is separated from next-to-top sheets.

In the embodiment shown in the figures, pad 60 and pads 62 and 64 are positioned relative to one another such that pad 60 will be slightly higher than pads 62 and 64 when pad 60 is pressed against pick roller 42 and slightly lower than pads 62 and 64 when pad 60 is withdrawn from pick roller 42. In this configuration, when pad 60 is pressed against pick roller 42, pad 60 lifts top sheet 30 and, perhaps, one or two next-to-top sheets to momentarily reduce the separating effect of pads 62 and 64 and allow top sheet 30 to move more easily into the nip 74 between pad 60 and pick roller 42. When pad 60 is withdrawn, pad 60 no longer retards the progress of top sheet 30 as pick roller 42 continues to move top sheet 30 over pads 62 and 64 along media path 28 toward feed roller 48.

At the end of the pick cycle, after the trailing edge of top sheet 30 has cleared the feed area, kickers 70 are rotated up, as indicated by the phantom lines in FIG. 4, to push stack 40 back into position for the start of the next pick cycle. (Kickers 70 are also shown in FIG. 7.) Kickers 70 are then withdrawn to the resting position, indicated by the solid lines in FIG. 4.

Figure 9:
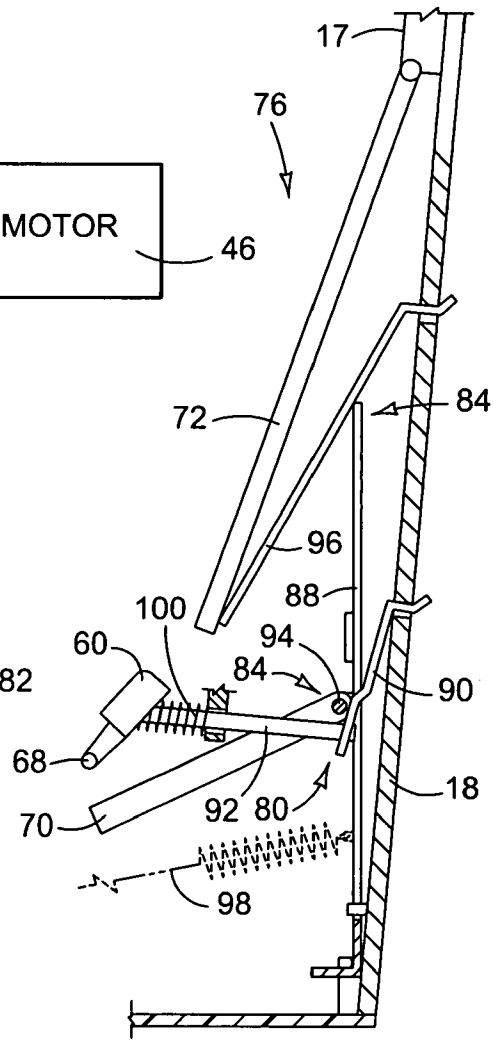
FIG. 9 is a side elevation and partial section view taken along the line 9—9 in FIG. 8.

FIGS. 8 and 9 illustrate one embodiment of an actuator 76 for moving separator pad 60, kickers 70 and pressure plate 72. FIG. 9 is a side elevation and partial section view taken along the line 9—9 in FIG. 8. Some of the components of actuator 76 are also visible in FIGS. 2–6. A similar actuator is used in Hewlett-Packard Company's Deskjet® 5150 and other horizontal feed inkjet printer models. Referring to FIGS. 8 and 9, separator pad 60 and kickers 70 move at the urging of motor 46 acting through actuator 76. Actuator 76 includes a cam 78, a linkage 80 for moving separator pad 60, a linkage 82 for moving kickers 70, and a linkage 84 for moving pressure plate 72. Motor 46 turns cam 78 through a gear train 86. Separator pad linkage 80 includes a pick lever 88, a separator pad lift lever 90 and a separator pad lift rod 92. Kicker linkage 82 includes an L-shaped pivot rod 94 that transfers the rotation of cam 78 to kickers 70. Pressure plate linkage 84 includes pick lever 88 and a pressure plate lift lever 96.

In operation, and referring first to FIGS. 2, 8 and 9, cam 78 is rotated to release pick lever 88, as shown in FIG. 2. When released, pick lever 88 pivots forward (counter-clockwise in FIGS. 2 and 9) at the urging of biasing spring 98 to allow separator pad lift lever 90 to pivot forward (clockwise in FIGS. 2 and 9) and to pivot pressure plate lift lever 96 forward (clockwise in FIGS. 2 and 9). Pad lift lever 90 pushes lift rod 92 up to move separator pad 60 against pick roller 42. In the embodiment shown in the figures, a biasing spring 100 moves separator pad 60 against pick roller 42. Pressure plate lift lever 96 pushes the bottom of pressure plate 72 out to move stack 40 against pick roller 42.

As shown in FIG. 3, cam 78 is rotated against pick lever 88 to move separator pad 60 away from pick roller 42. Pick lever 88 pivots backward (clockwise in FIG. 3) to pivot separator pad lift lever 90 backward (clockwise in FIG. 3) and to release pressure plate lift lever 96. Pad lift lever 90 pulls lift rod 92 down to move separator pad 60 away from pick roller 42. As cam 78 continues to rotate, it engages and rotates pivot rod 94 to swing kickers 70 up against stack 40, as shown by the phantom lines in FIG. 4, and put stack 40 back into position for the start of the next pick cycle.

Carriage 20 and printhead 26 along with other hardware components necessary to deliver ink to the print media are referred to collectively as a print engine. Rollers 42, 48 and 50 along with other hardware components necessary to transport print media through printer 10 are referred to collectively as a pick/feed mechanism. Controller 36 includes the programming, processor and associated memory and electronic circuitry necessary to control the print engine, the pick/feed mechanism, and the other operative components of printer 10.

The exemplary embodiments shown in the figures and described above illustrate but do not limit the invention. Other forms, details, and embodiments may be made and implemented. Hence, the foregoing description should not be construed to limit the scope of the invention, which is defined in the following claims.

What is claimed is:

1. A sheet media input structure for a sheet media processing device, comprising:

a sheet media supporting surface;

a movable pad downstream from the supporting surface along a media path that extends from the supporting surface to and along the movable pad;

a pair of stationary pads downstream from the supporting surface along the media path at a location where the stationary pads impede a leading edge of sheets fed along the media path from a stack of sheets supported by the supporting surface; and the movable pad movable between a first position in which the movable pad impedes a leading edge of sheets as the sheets are fed from the stack along the media path and a second position in which the movable pad does not impede the leading edge of sheets fed from the stack along the media path.

2. The structure of claim 1, wherein a contact surface of each pad comprises the same elastomeric material.

3. The structure of claim 2, wherein the movable pad and the stationary pads are aligned with one another across the media path.

4. The structure of claim 1, wherein the sheet media supporting surface comprises a substantially vertical surface extending across the media path.

5. The structure of claim 1, wherein the sheet media supporting surface comprises a shelf extending across the media path to support the leading edge of sheets in the stack.

6. The structure of claim 1, wherein the stationary pads are spaced apart from the movable pad across the media path.

7. A sheet media input structure for a sheet media processing device, comprising a combination of movable and stationary sheet separator pads disposed across a sheet media path, at least one of the pads movable to vary the degree to which the pads, in combination, impede the leading edge of sheets fed along the media path, the movable pad rotatable about a pivot and having a distal end, the pivot being positioned farther from the sheets than the distal end when the movable pad is in a retracted position.

8. A sheet media input structure for a sheet media processing device, comprising:

a sheet media supporting surface;

a first movable feature having a pivot and a pad, downstream from the supporting surface along a media path that extends from the supporting surface to and along the first feature, the first feature configured to separate a top sheet in a stack of sheets supported on the supporting surface from a next-to-top sheet in the stack, the pivot being downstream from the pad;

a second stationary feature spaced apart from the first feature across the media path, the second feature configured to separate a top sheet in the stack from a next-to-top sheet; and an actuator operative to move the first feature between a first position in which the first feature impedes a leading edge of sheets fed from the stack along the media path and a second position in which the first feature does not impede the leading edge of sheets fed along the media path and the second feature impedes the leading edge of sheets fed along the media path.

9. The structure of claim 8, wherein:

the first feature comprises an elastomeric pad oriented at an obtuse angle relative to the supporting surface when the first feature is in the first position; and the second feature comprises an elastomeric pad oriented at an obtuse angle relative to the supporting surface.

10. The structure of claim 8, wherein the first feature is biased toward the first position.

11. The structure of claim 8, wherein:

the first feature comprises an elastomeric pad oriented at an obtuse angle relative to the supporting surface when the first feature is in the first position; and the second feature comprises a pair of elastomeric pads oriented at an obtuse angle relative to the supporting surface, each pad located on opposite sides of the first feature.

12. The structure of claim 8, wherein the second feature does not impede the leading edge of sheets fed along the media path when the first feature is in the first position.

13. A sheet media pick mechanism comprising;

a substantially vertical sheet media input tray;

a combination of movable and stationary sheet separator pads disposed across a sheet media path, at least one of the pads movable to vary the degree to which the pads, in combination, impede the leading edge of sheets fed from the tray along the media path;

a rotatable pick roller diagnosed adjacent to the media path opposite a movable one of the separator pads;

wherein the input tray includes a substantially vertical stationary upper sheet supporting surface and a rotatable lower sheet supporting surface below the upper surface, the lower surface rotatable between a first position in which the lower surface is substantially vertical and a second position in which a bottom part of the lower surface adjacent to the pick roller is rotated out toward the pick roller.

14. A sheet media input structure for a sheet media processing device, comprising:

a sheet media supporting surface;

a movable pad downstream from the supporting surface along a media path that extends from the supporting surface to and along the movable pad;

a pair of stationary pads downstream from the supporting surface along the media path at a location where the stationary pads impede but do not block a leading edge of a top sheet fed along the media path from a stack of sheets supported by the supporting surface; and the movable pad movable between a first position in which the movable pad impedes but does not block a leading edge of the top sheet fed from the stack along the media path and a second position in which the movable pad does not impede the leading edge of the top sheet fed from the stack along the media path.

15. A sheet media pick mechanism, comprising:

a substantially vertical sheet media input tray;

a combination of movable and stationary sheet separator pads disposed across a sheet media path, at least one of the pads movable to vary the degree to which the pads, in combination, impede the leading edge of sheets fed from the tray along the media path;

a rotatable pick roller disposed adjacent to the media path opposite a movable one of the separator pads;

wherein a movable pad is movable between a first position in which the movable pad contacts the pick roller to form a nip between the movable pad and the pick roller and a second position in which the movable pad does not contact the pick roller.

16. A sheet media pick mechanism, comprising:

a substantially vertical sheet media input tray;

a combination of movable and stationary sheet separator pads disposed across a sheet media path, at least one of the pads movable to vary the degree to which the pads, in combination, impede the leading edge of sheets fed from the tray along the media path;

a rotatable pick roller disposed adjacent to the media path opposite a movable one of the separator pads;

a kicker that is discrete from any movable separator pad, the kicker disposed adjacent to the media path and the kicker operative at the end of a pick cycle to return sheets to the input tray.

* * * * *

UNITED STATES PATENT AND TRADEMARK OFFICE

CERTIFICATE OF CORRECTION

PATENT NO. : 7,100,914 B2
APPLICATION NO. : 10/758057
DATED : September 5, 2006
INVENTOR(S) : Juan D. Ramos It is certified that error appears in the above-identified patent and that said Letters Patent is hereby corrected as shown below:

In column 5, line 2, in Claim 1, after “sheets” insert -- as the sheets are --.

In column 6, line 1, in Claim 13, delete “mechanism comprising;” and insert -- mechanism, comprising: --, therefor.

In column 6, line 9, in Claim 13, delete “diagnosed” and insert -- disposed --, therefor.

Signed and Sealed this

Thirteenth Day of January, 2009

JON W. DUDAS
*Director of the United States Patent and Trademark Office*